US009136959B2

(12) United States Patent
Namba

(10) Patent No.: US 9,136,959 B2
(45) Date of Patent: Sep. 15, 2015

(54) VEHICULAR COMMUNICATION APPARATUS AND VEHICULAR COMMUNICATION SYSTEM

(71) Applicant: DENSO CORPORATION, Kariya, Aichi-pref. (JP)

(72) Inventor: Yuri Namba, Obu (JP)

(73) Assignee: DENSO CORPORATION, Kariya (JP)

( * ) Notice: Subject to any disclaimer, the term of this patent is extended or adjusted under 35 U.S.C. 154(b) by 243 days.

(21) Appl. No.: 13/754,009

(22) Filed: Jan. 30, 2013

(65) Prior Publication Data

US 2013/0203340 A1 Aug. 8, 2013

(30) Foreign Application Priority Data

Feb. 2, 2012 (JP) ..... 2012-020803

(51) Int. Cl.

| | |
|---|---|
| ***H04H 40/00*** | (2009.01) |
| ***H04H 20/53*** | (2008.01) |
| ***H04H 20/24*** | (2008.01) |
| ***H04H 20/26*** | (2008.01) |

(52) U.S. Cl.

CPC ..... *H04H 20/53* (2013.01); *H04H 20/24* (2013.01); *H04H 20/26* (2013.01)

(58) Field of Classification Search

None

See application file for complete search history.

(56) References Cited

U.S. PATENT DOCUMENTS

| | | | | |
|---|---|---|---|---|
| 7,711,838 | B1 | 5/2010 | Boulter et al. | |
| 2005/0160465 | A1 | 7/2005 | Walker | |
| 2006/0153194 | A1* | 7/2006 | Kim | 370/392 |
| 2007/0299930 | A1* | 12/2007 | Wendelrup et al. | 709/217 |
| 2008/0311852 | A1* | 12/2008 | Hansen et al. | 455/41.2 |
| 2010/0150525 | A1 | 6/2010 | Walker | |
| 2013/0040666 | A1* | 2/2013 | Chin et al. | 455/458 |

FOREIGN PATENT DOCUMENTS

| | | |
|---|---|---|
| JP | 63-007688 | 1/1988 |
| JP | 2011-146896 A | 7/2011 |

OTHER PUBLICATIONS

Office Action issued Jan. 13, 2015 in corresponding JP Application No. 2012-020803 (with English translation).

* cited by examiner

*Primary Examiner* — Edward Urban
*Assistant Examiner* — Mohammed Rachedine
(74) *Attorney, Agent, or Firm* — Harness, Dickey & Pierce, PLC

(57) ABSTRACT

A vehicular communication apparatus includes: a first acquisition portion acquiring a first content delivered by a radio wave from a broadcast station; a second acquisition portion acquiring a second content delivered by a communication line network; a reproduction portion reproducing the first and second contents; a determination portion determining whether a radio wave reception condition is poor; and a controller changing a content to be reproduced by the reproduction portion from the first content to the second content when the determination portion detects poor radio wave reception condition under a condition that the reproduction portion reproduces the first content, the second content being a same or a similar type of the first content.

4 Claims, 10 Drawing Sheets

FIG. 2

B STATION INF TABLE FOR EACH PREF

| PREF | FREQUENCY | B STATION |
|---|---|---|
| A PREF. | 77.7 | AAA RADIO |
| A PREF. | 88.8 | BBB-FM |
| A PREF. | 99.9 | CCC BROADCAST |
| B PREF. | 77.7 | DDD RADIO (AFFILIATED WITH AAA RADIO) |
| B PREF. | 67.8 | EEE RADIO |
| ⋮ | ⋮ | ⋮ |

FIG. 3

B STATION INF TABLE FOR EACH ZIP CODE

| ZIP CODE | FREQUENCY | B STATION |
|---|---|---|
| 444-xxxx | 77.7 | AAA RADIO |
| 444-xxxx | 88.8 | BBB-FM |
| 443-xxxx | 77.7 | AAA RADIO |
| 443-xxxx | 99.9 | CCC BROADCAST |
| 443-xxxx | 67.8 | EEE RADIO |
| 421-xxxx | 77.7 | DDD RADIO (AFFILIATED WITH AAA RADIO) |
| 421-xxxx | 67.8 | EEE RADIO |
| ⋮ | ⋮ | ⋮ |

VEHICULAR COMMUNICATION APPARATUS AND VEHICULAR COMMUNICATION SYSTEM

CROSS REFERENCE TO RELATED APPLICATION

This application is based on Japanese Patent Application No. 2012-20803 filed on Feb. 2, 2012, the disclosure of which is incorporated herein by reference.

TECHNICAL FIELD

The present disclosure relates to a vehicular communication apparatus and a vehicular communication system.

BACKGROUND

A vehicle is equipped with a receiver such as a tuner that receives radio or television broadcast, for example. Many receivers have a so-called auto-preset function that automatically stores receivable frequencies. A user can select a stored frequency to audiovisually acquire radio or television programs, namely, contents delivered by way of radio waves in the vehicle.

Broadcast stations provide broadcast for respective regions. A broadcast station transmits a radio wave using an output capable of the broadcast in the region. If the vehicle moves outside the broadcast region, a radio wave reception condition degrades, making audiovisual acquisition of contents difficult. For example, the technology disclosed in patent document 1 changes the frequency to the others if audiovisual acquisition of the content is difficult. The technology provides contents that can be audiovisually acquired in good reception conditions.

However, a content delivered at a different frequency does not necessarily equal the previously delivered content. The technology of the related art changes the frequency to the others if the reception condition degrades. Such a technology cannot satisfy the request of users who want to continue to audiovisually acquire the most recently content.

[Patent document 1] JP-A-S63-7688

SUMMARY

It is an object of the present disclosure to provide a vehicular communication apparatus and a vehicular communication system capable of continuously delivering contents even if a radio wave reception condition of radio broadcasting degrades.

According to a first aspect of the present disclosure, a vehicular communication apparatus includes: a first acquisition portion that receives a radio wave transmitted from an external broadcast station and acquires a first content delivered by way of the radio wave; a second acquisition portion that performs data communication with an external communication line network and acquires a second content delivered by the external communication line network; a reproduction portion that reproduces the first content acquired by the first acquisition portion and the second content acquired by the second acquisition portion; a determination portion that determines whether a radio wave reception condition is poor so that a poor radio wave reception condition affects content acquisition in the first acquisition portion; and a controller that changes a content to be reproduced by the reproduction portion from the first content to the second content when the determination portion detects the poor radio wave reception condition under a condition that the reproduction portion reproduces the first content, the second content being a same or a similar type of the first content.

The vehicular communication apparatus changes content acquisition destinations according to the radio wave reception condition. Accordingly, a user can continuously audiovisually acquire the content acquired by the first acquisition portion even if a vehicle moves out of a broadcast region and the radio wave reception condition degrades. Some broadcast stations may not deliver on-air contents via the communication line network. Even in this case, the user can acquire the same type of contents that meet his or her preferences.

According to a second aspect of the present disclosure, a vehicular communication system includes: the vehicular communication apparatus according to the first aspect; a mobile communication terminal that is connected to the vehicular communication apparatus so that the mobile communication terminal mediates the data communication between the vehicular communication apparatus and the external communication line network; and a server that is connected to the external communication line network, and stores content information about the first content delivered by way of the radio wave and the second content delivered by way of the communication line network. The vehicular communication apparatus transmits audiovisual acquisition information to the server. The audiovisual acquisition information indicates the first content that is acquired by the first acquisition portion and is being reproduced by the, reproduction portion. The server searches for the same or the similar type of the first content based on the audiovisual acquisition information transmitted from the vehicular communication apparatus. The vehicular communication system can provide the effects in the first aspect described above. The server stores information about contents delivered by way of the communication line network. The vehicular apparatus need not perform the search process. This can decrease processes on the vehicular apparatus and shorten the time to connect to the communication line network. The mobile communication terminal can be protected against battery drain. Possible charging in the data communication can be controlled.

BRIEF DESCRIPTION OF THE DRAWINGS

The above and other objects, features and advantages of the present disclosure will become more apparent from the following detailed description made with reference to the accompanying drawings. In the drawings:

FIG. 2 illustrates a diagram of a broadcast station information table based on prefectures stored in a server;

FIG. 3 illustrates a diagram of a broadcast station information table based on zip codes stored in a server;

DETAILED DESCRIPTION

Figure 1:
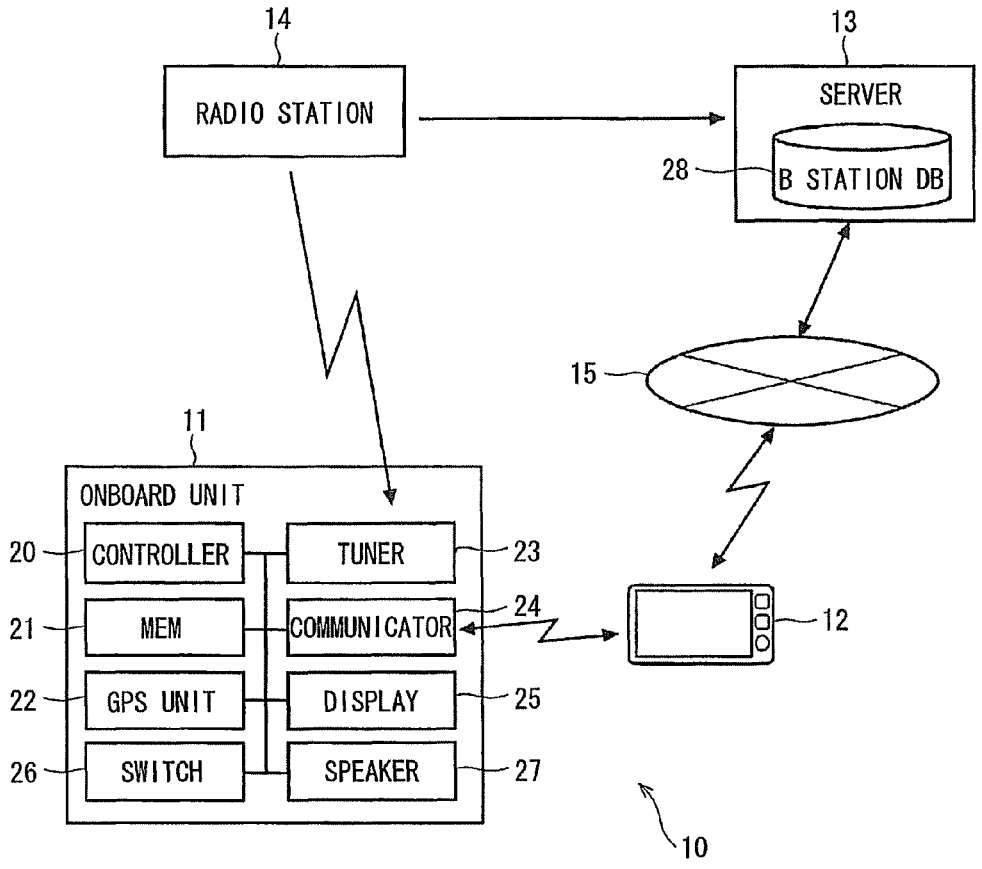
FIG. 1 schematically illustrates a diagram of a vehicular communication apparatus and a vehicular communication system according to a first embodiment.

Embodiments of the vehicular communication apparatus and the vehicular communication system according to the present disclosure will be described with reference to the accompanying drawings. The components common to the embodiments are depicted by the same reference numerals and a detailed description is omitted for simplicity.

First Embodiment

The following describes the vehicular communication apparatus and the vehicular communication system according to the first embodiment of the disclosure with reference to FIGS. 1 through 11.

As illustrated in FIG. 1, a vehicular communication system 10 includes an onboard unit 11 as a vehicular communication apparatus, a mobile communication terminal 12, and a server 13. As will be described later, the onboard unit 1 enables audiovisual acquisition of a program (hereinafter referred to as a radiobroadcast) broadcast from a radiobroadcast station 14 and a program delivered from the radiobroadcast station 14 via the server 13 and a communication line network 15. The embodiment assumes the Internet to be the communication line network 15. Contents delivered by way of the communication line network 15 are equivalent to Internet radios.

The onboard unit 11 includes a controller 20, a storage 21, a GPS unit 22, a tuner portion 23, a communicator 24, a display portion 25, a switch group 26, and a speaker 27. The controller 20 is configured as a microcomputer having a CPU, RAM, ROM, and an input/output interface (not shown). The controller 20 controls the whole of the onboard unit 11 such as communication operation and display operation in accordance with a computer program stored in the ROM or the storage 21. As will be described in detail, the controller 20 performs a determination process that determines reception conditions of radio waves received by the tuner portion 23. The controller 20 is equivalent to a determination portion. According to the embodiment, the determination portion is provided as software, namely, a program performed by the controller 20. The determination portion may be provided as hardware in the tuner portion 23.

The storage 21 stores a computer program to control the onboard unit 11 and various data. The storage 21 is available as a storage medium such as an HDD, a memory card, or a DVD capable of reading and writing various data.

The GPS unit 22 includes an antenna, an RF circuit portion, and sensors such as a geomagnetic sensor and a gyroscope (not shown). The GPS unit 22 complements signals supplied from these sensors to acquire vehicle position information. The GPS unit 22 need not have all sensors if the vehicle position information can be acquired with the required detection accuracy. The GPS unit 22 outputs the acquired vehicle position information to the controller 20. The controller 20 performs known navigation functions such as route guidance and map mapping based on the vehicle position information acquired in the GPS unit 22 and a map database (DB) stored in the storage 21, for example. According to the embodiment, the onboard unit 11 is available as a known navigation system. The vehicular communication apparatus may be a movable or portable one as well as the onboard unit 11 that is fixed to the vehicle.

The tuner portion 23 receives a radio wave transmitted from the radiobroadcast station 14 via an antenna (not shown). The tuner portion 23 acquires radiobroadcast, namely, contents delivered from the radiobroadcast station 14 by way of radio waves. The content acquired by the tuner portion 23 is output from the speaker 27 under control of the controller 20. Specifically, the speaker 27 outputs audio of the radiobroadcast received by the tuner portion 23. The content acquired by the tuner portion 23 is thereby reproduced. The tuner portion 23 has an auto-preset function that presets radiobroadcast frequencies capable of audiovisual acquisition. As a known technology, the auto-preset function determines radio wave reception conditions received by the tuner portion 23 and presets frequencies capable of excellent reception conditions. The tuner portion 23 is equivalent to a first acquisition portion.

The communicator 24 connects the onboard unit 11 with the mobile communication terminal 12 so as to be capable of data communication. According to the embodiment, the communicator 24 uses Bluetooth (registered trademark) compliant with the near filed communication. A contactless state is maintained between the onboard unit 11 and the mobile communication terminal 12. The mobile communication terminal 12 is driven by its own battery. The communicator 24 may be available as a wireless LAN. The onboard unit 11 performs various data communications with the communication line network 15 via the communicator 24 and the mobile communication terminal 12. The communicator 24 acquires a content delivered from the server 13 via the communication line network 15. The content acquired by the communicator 24 is reproduced from the speaker 27. The communicator 24 is equivalent to a second acquisition portion.

The display portion 25 is available as a liquid-crystal display unit or an organic EL display unit, for example. The display portion 25 displays various information such as map screens and guidance routes used for the navigation function or manipulation menus for the onboard unit 11. As will be described in detail, the display portion 25 displays charging information about acquisition of a content before the communicator 24 (second acquisition portion) starts acquiring the content. The display portion 25 is equivalent to a notification portion. The display portion 25 may reproduce a content acquired by the tuner portion 23 and the communicator 24 if the content contains a video.

The switch group 26 includes touch screen manipulation switches corresponding to the screen of the display portion 25 and manipulation switches around the display portion 25. The switch group 26 accepts user's manipulation on the onboard unit 11 such as manipulation of navigation functions. As will be described in detail, the switch group 26 accepts manipulation of the charging information displayed on the display portion 25. The switch group 26 is equivalent to a manipulation input portion.

The speaker 27 reproduces contents or outputs audio of radio programs received by the tuner portion 23 and radio programs acquired via the communicator 24. In addition, the speaker 27 audibly guides the use of navigation functions or manipulation of the onboard unit 11, for example. The speaker 27 is equivalent to a reproduction portion.

According to the embodiment, the mobile communication terminal 12 connected to the onboard unit 11 is available as a mobile telephone or a smart phone. The mobile communication terminal 12 enables various data communications between the onboard unit 11 and the communication line network 15. The mobile communication terminal 12 also enables various data communications with the server 13 via the communication line network 15.

The server 13 is configured as a computer system (not shown). The server 13 includes a broadcast station database (DB) 28 that stores information about the radiobroadcast station 14. The information about the radiobroadcast station 14 includes a broadcast station information table based on prefectures as illustrated in FIG. 2 or a broadcast station information table based on zip codes as illustrated in FIG. 3, for example. The broadcast station information tables as illustrated in FIGS. 2 and 3 store frequencies and broadcast station names of the radiobroadcast stations 14 that can deliver contents via the communication line network 15 according to prefectures or zip codes. In addition to the broadcast station information tables as illustrated in FIGS. 2 and 3, the server 13 uses the broadcast station DB 28 to store a program listing or a list of on-air contents and content types such as on-air song titles, artist names, and genres. The information about the radiobroadcast station 14 such as the broadcast station information tables stored in the broadcast station DB 28 is equivalent to content information.

The server 13 acquires information (hereinafter referred to as content information) about the radiobroadcast station 14 directly or indirectly via the communication line network 15 from the broadcast station. While FIG. 1 illustrates one radiobroadcast station 14, the server 13 uses the broadcast station DB 28 to store the content information about more than one radiobroadcast station 14. The server 13 uses the broadcast station DB 28 to store more than one content information regardless of broadcast regions or countries of the radiobroadcast stations 14 at home or abroad.

The embodiment assumes that a content is delivered from the server 13; namely, a content provided from the radiobroadcast station 14 is re-delivered from the server 13 by way of the communication line network 15. When connecting with the server, the onboard unit 11 can acquire contents by way of the communication line network 15 almost at the same time. Suppose a case where the server 13 does not re-deliver contents or the radiobroadcast station 14 directly delivers contents by way of the communication line network 15. In such a case, the broadcast station DB 28 may store a Uniform Resource Locator (URL) or a connection destination to acquire a content. The onboard unit 11 may be provided with the URL. A "content delivered by way of a communication line network" includes a content re-delivered via the server 13 and a content directly delivered to the communication line network 15 from the radiobroadcast station 14.

The following describes operations of the vehicular communication apparatus and the vehicular communication system 10 according to the above-mentioned configurations.

To audiovisually acquire a radio broadcast, a user selects any one of frequencies preset on the onboard unit 11 or explicitly specifies a targeted frequency. In this case, the onboard unit 11 enables audiovisual acquisition of the radio broadcast via the tuner portion 23 or the mobile communication terminal 12. However, audiovisual acquisition of radio broadcasts using the mobile communication terminal 12 consumes the battery of the mobile communication terminal 12 and requires charging for data communication. Many users are supposed to audiovisually acquire radio broadcasts using the tuner portion 23.

Suppose a case where a vehicle goes out of the broadcast region while a radio broadcast is audiovisually acquired. In such a case, the radio wave reception condition degrades to make difficult the audiovisual acquisition of the content. The onboard unit 11 and the vehicular communication system 10 enable continuous audiovisual acquisition of contents as follows. The following mainly describes the onboard unit 11 for simplicity. In the following description, audiovisual acquisition of Internet radio signifies that of contents acquired via the communicator 24 by way of the communication line network 15.

The onboard unit 11 predetermines whether to automatically acquire contents using the communicator 24 (second acquisition portion) if acquisition of contents using the tuner portion 23 (first acquisition portion) is difficult. More specifically, the onboard unit 11 predetermines whether to enable an automatic changeover process to be described later with reference to FIG. 5. This setting is included as an item in the radio reception setup and is enabled at any time when the onboard unit 11 is mounted for example.

Figure 4:
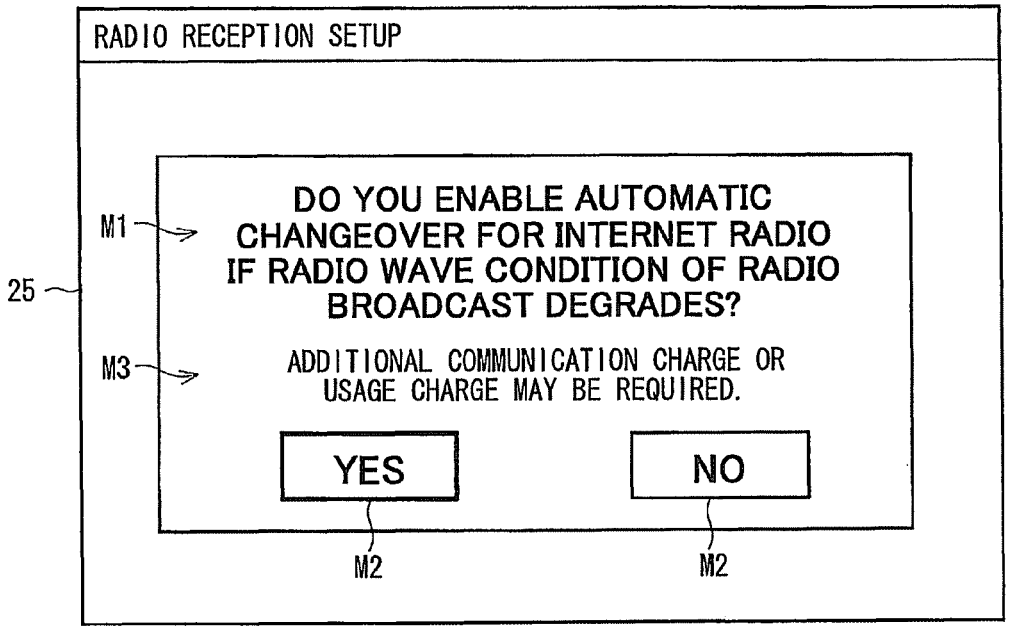
FIG. 4 illustrates a diagram of a screen display for radio reception setup.

As illustrated in FIG. 4, the onboard unit 11 allows the display portion 25 to display a setup screen, having a confirmation message M1 and a selection button M2. The selection button M2 is an icon that can be manipulated using the touch screen provided for the display portion 25. In this case, the confirmation message M1 provides a fixed phrase such as "do you enable the automatic changeover process for Internet radio if the radio broadcast degrades the radio wave condition?" The confirmation message M1 is followed by an attention message M3 such as "an additional communication charge or usage charge may be required."

Audiovisual acquisition of the Internet radio may require charges such as a communication charge and a usage charge to acquire contents. The onboard unit 11 displays the attention message M3 notifying the user of possible charging to prevent the user from being disadvantaged due to unexpected charging. The attention message is equivalent to charging information. The charging information may contain an estimated communication charge needed for one-hour audiovisual acquisition of the Internet radio, for example.

To enable the automatic changeover process, the user selects "Yes" for the selection button M2 to allow the charging. Some users may contract paying a predetermined charge regardless of the amount of data (flat-rate service). Such users are considered to usually select "Yes" because audiovisually acquiring the Internet radio does not increase the communication charge. By contrast, other users may contract paying depending on the amount of data (pay-as-you-go service). Such users can select "No" to disable the automatic changeover process and prevent the communication charge from increasing.

The following describes a case of selecting "Yes" in FIG. 4 to enable the automatic changeover process. A case of selecting "No" in FIG. 4 will be described in a second embodiment.

Figure 5:
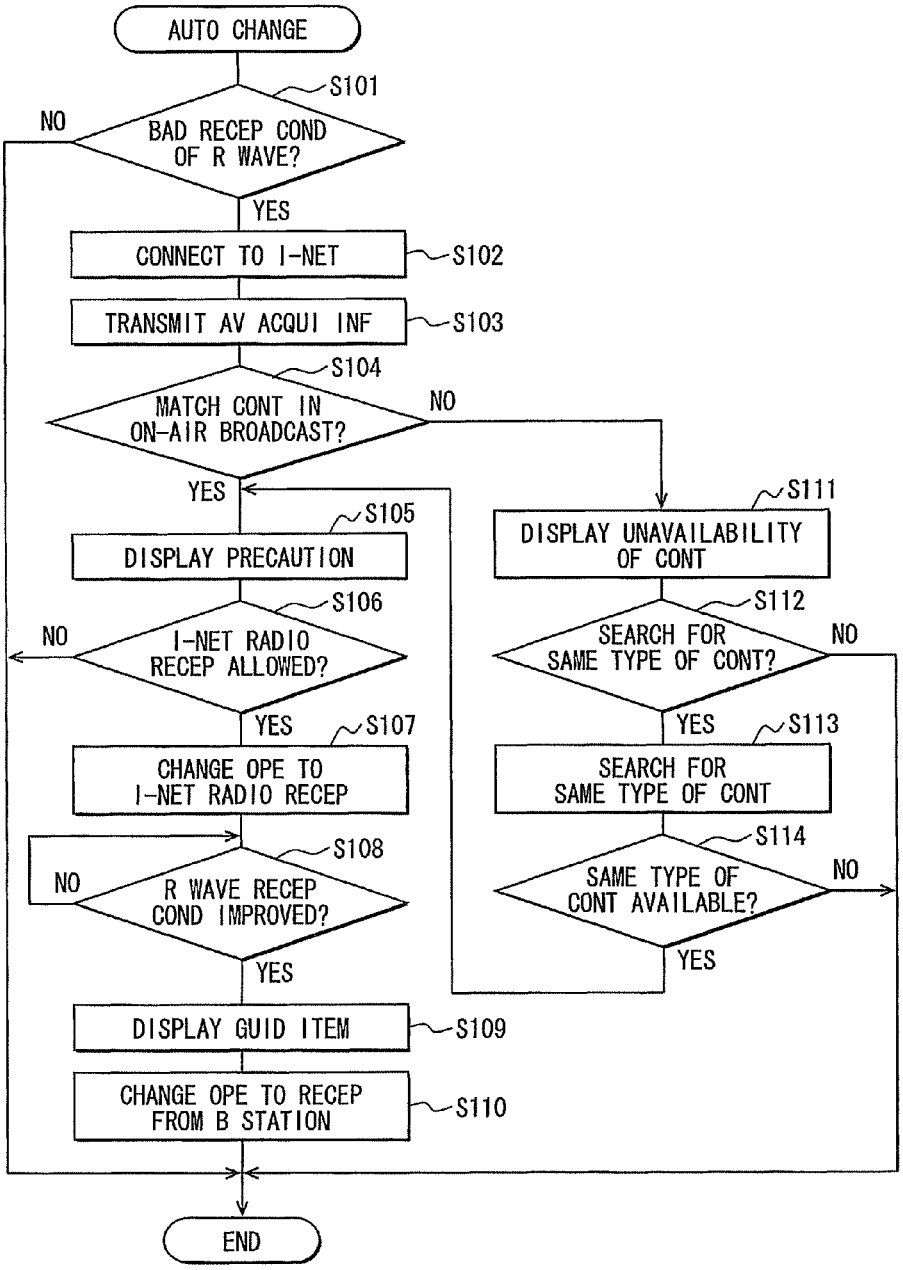
FIG. 5 illustrates a flowchart of an automatic changeover process.

During audiovisual acquisition of a radio broadcast, the onboard unit 11 performs the automatic changeover process illustrated in FIG. 5. The onboard unit 11 determines whether the tuner portion 23 receives a radio wave under an incorrect reception condition for audiovisual acquisition of the radio broadcast (S101). The incorrect reception condition here is assumed to disable the auto-preset function. The onboard unit 11 determines whether the radio wave reception condition is so bad as to affect acquisition of contents by the tuner portion 23 (first acquisition portion). The onboard unit 11 terminates the process if the reception condition is not bad (NO at S101). While the process terminates according to the flowchart for simplicity, the onboard unit 11 repeatedly performs the automatic changeover process illustrated in FIG. 5 during reception of the radio broadcast.

Figure 6:
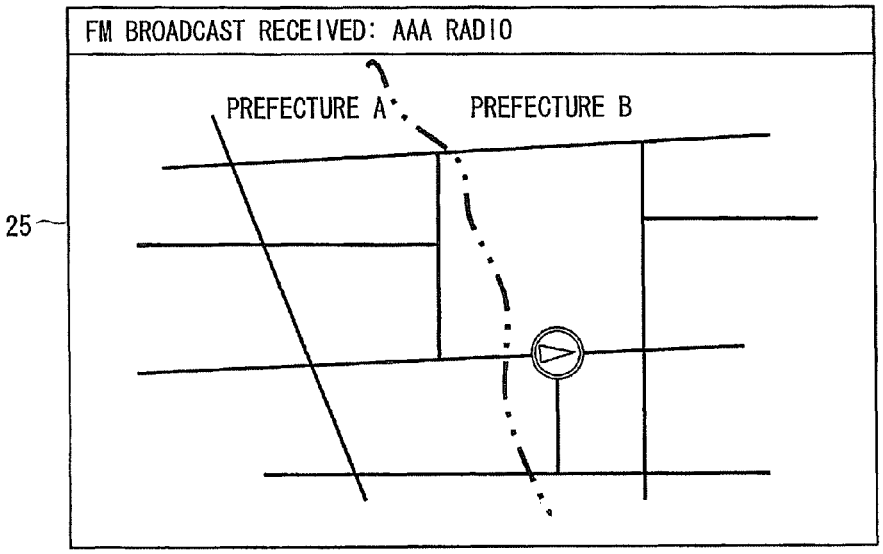
FIG. 6 illustrates a diagram of a screen display for radio-broadcast reception.

Suppose that the vehicle moves from prefecture A to prefecture B as illustrated in FIG. 6. This weakens the radio wave of an audiovisually acquired radio broadcast transmitted from the radiobroadcast station 14 in prefecture A. The onboard unit 11 may determine that the automatic changeover process in FIG. 5 indicates a bad reception condition (YES at S101). The onboard unit 11 then connects to the communication line network 15 (hereinafter referred to as the Internet for descriptive purposes) (S102). Connection to the Internet may cause a communication charge. However, charging between S102 and S104 is considered permissible. This is because the automatic changeover process is enabled as described above and the time required up to S103 and S104 is short. Therefore, the onboard unit 11 connects to the Internet without requiring the user's input manipulation.

When connecting to the Internet, the onboard unit 11 transmits audiovisual acquisition information to the server 13 (S103). According to the embodiment, the audiovisual acquisition information includes the frequency or the broadcast station name of a radio broadcast being audiovisually acquired. The server 13 searches for content information as illustrated in FIG. 2 or 3 based on the audiovisual acquisition information transmitted from the onboard unit 11. The server 13 transmits a search result to the onboard unit 11. The search result indicates whether the audiovisual acquisition using the Internet is available. The audiovisual acquisition information transmitted from the onboard unit 11 to the server 13 may contain the current vehicle position or the geographical name acquired by the GPS unit 22. In this case, the server 13 may search for the radiobroadcast station 14 corresponding to the current position or the geographical name from the content information and transmit a list of search results to the onboard unit 11.

Based on the search result transmitted from the server 13, the onboard unit 11 determines whether there is a delivered content matching the radio broadcast being audiovisually acquired or received (S104). In this case, as illustrated in FIG. 2, the matching content may include DDD Radio that differs from AAA Radio in the broadcast station name but uses the same frequency as AAA Radio and therefore is affiliated with it. The affiliated broadcast station is highly likely to broadcast the same program. If the current position is transmitted as the audiovisual acquisition information, the onboard unit 11 may use the display portion 25 to display a list of broadcast stations as illustrated in FIG. 2 and allow the user to select any one of the broadcast stations.

Figure 7:
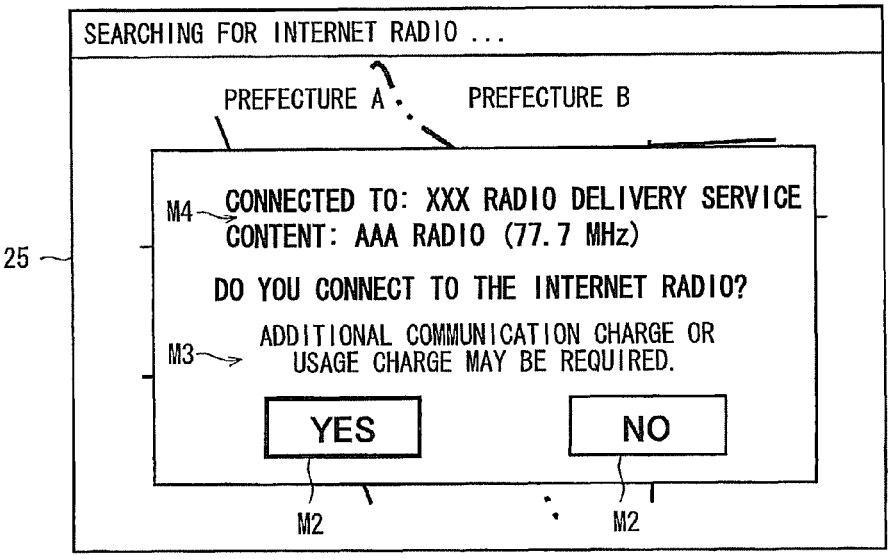
FIG. 7 illustrates a diagram of a first example of a screen display to change reception mode.

For example, suppose a case where the radio broadcast being audiovisually acquired is AAA Radio (frequency 77.7 MHz). In such a case, as illustrated in FIG. 2, AAA Radio is stored as the content information, namely, the radiobroadcast station 14 capable of audiovisual acquisition using the Internet. In this case, there is a delivered content matching the radio broadcast being audiovisually acquired or received (YES at S104). The onboard unit 11 displays precautions on-screen (ONS) (S105). The onboard unit 11 allows the display portion 25 to display a precaution screen as illustrated in FIG. 7. The precaution screen contains a connection information message M4, the attention message M3, and the selection button M2. The connection information message M4 shows a connection destination on the Internet for audiovisual acquisition and a content type. For example, the connection information message M4 contains a service provider name such as XXX Radio Delivery Service and the content type such as AAA Radio (77.7 MHz)

Figure 8:
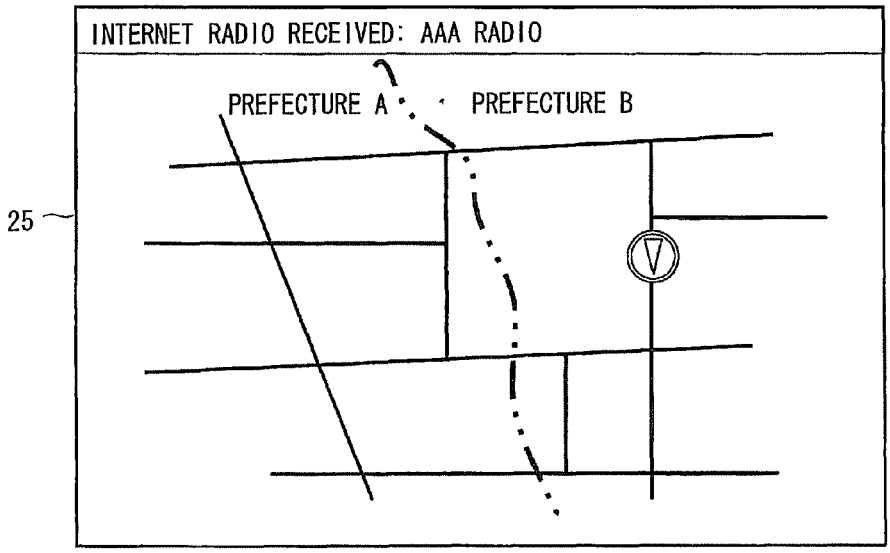
FIG. 8 illustrates a diagram of a screen display for Internet radio reception.

The onboard unit 11 displays the attention message M3 to notify that audiovisual acquisition of the Internet radio may require a communication charge. The onboard unit 11 thereby accepts the user's input manipulation to allow or disallow the charging and re-confirms whether to allow the possible charging. The user may manipulate the selection button M2 for "Yes" to allow the charging (YES at S106). The onboard unit 11 then enables the Internet radio reception (S107). The user can thereby continue to audiovisually acquire the same program as the radio broadcast previously audiovisually acquired in prefecture A even if the vehicle moves to prefecture B as illustrated in FIG. 8. If the user disallows the charging (NO at S106), the onboard unit 11 disables connection to the Internet and terminates the process.

The onboard unit 11 enables the audiovisual acquisition using the Internet radio based on the user's confirmation if the radio wave reception condition degrades to make the audiovisual acquisition difficult during the radio broadcast received by the tuner portion 23.

Suppose a case where the audiovisual acquisition using the Internet radio is enabled, and then the vehicle moves to prefecture A again. In such a case, the audiovisual acquisition using the Internet radio can remain enabled. However, reception using the tuner portion 23 is favorable in consideration of a possible communication charge or battery drain of the mobile communication terminal 12. Recently, the flat-rate service is re-examined as data communication charges increase. The pay-as-you-go service may cause an expensive charge if the Internet radio is audiovisually acquired for a long time.

Figure 9:
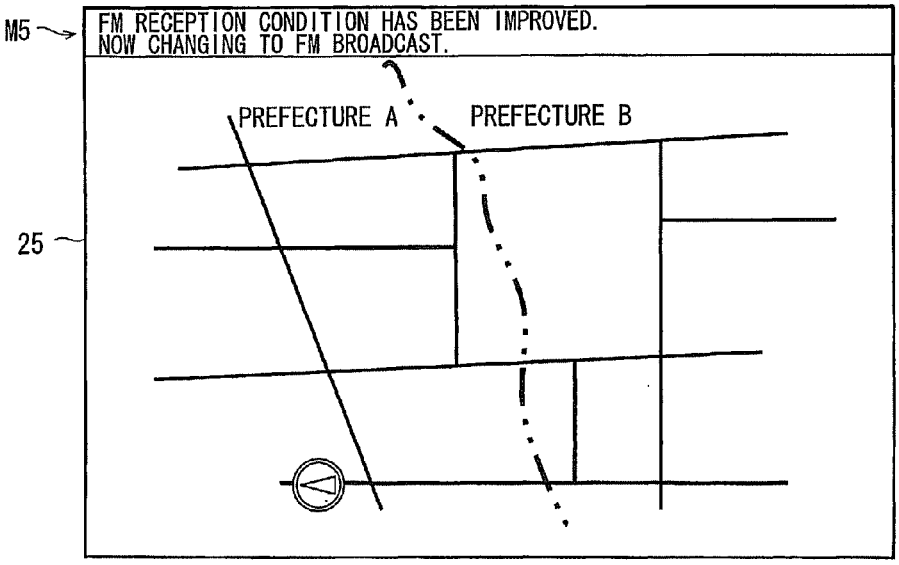
FIG. 9 illustrates a diagram of a second example of a screen display to change reception mode.

As illustrated in FIG. 5, the onboard unit 11 performs the automatic changeover process to enable the audiovisual acquisition using the Internet radio and then determines whether the radio wave reception condition is improved (S108). If the reception condition is not improved (NO at S108), the onboard unit 11 repeats the determination until the reception condition is improved. If the radio reception condition is improved (YES at S108), the onboard unit 11 displays a guidance item (guidance message M5) ONS as illustrated in FIG. 9 (S109). The onboard unit 11 then changes the audiovisual acquisition to the reception from the broadcast station, namely, the reception of the radio broadcast using the tuner portion 23 (S110).

The audiovisual acquisition is changed to the reception of radio broadcast if the radio wave reception condition is improved. This can prevent a possible communication charge or excessive battery drain of the mobile communication terminal 12.

Figure 10:
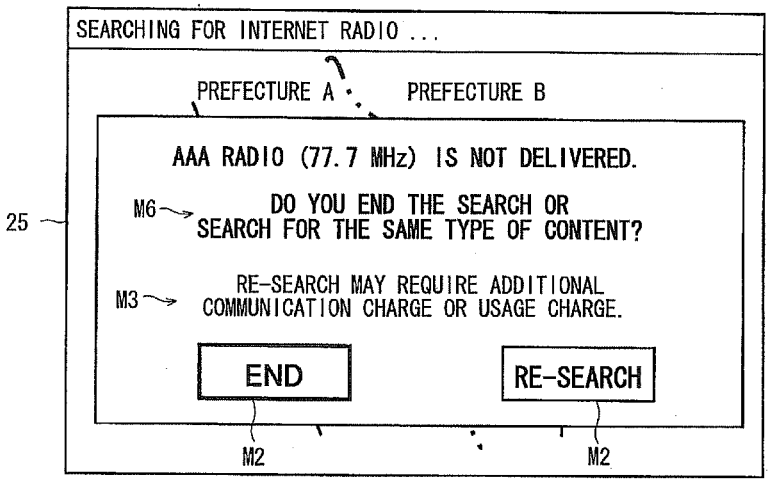
FIG. 10 illustrates a diagram of a screen display for content re-search.

Depending on conditions, the radiobroadcast station 14 may not enable audiovisual acquisition of the Internet radio. For example, suppose a case where the broadcast station information table in FIG. 2 does not contain AAA Radio. In such a case, the Internet radio cannot provide contents of AAA Radio. The automatic changeover process in FIG. 5 may not provide any deliverable content matching the broadcast being received (NO at S104). The onboard unit 11 notifies unavailability of a deliverable matching content (S111) and then displays a selection screen to determine whether to search for the same type of contents (S112). As illustrated in FIG. 10, the onboard unit 11 prompts the user's manipulation by displaying a search message M6 such as "AAA Radio (77.7 MHz) is unavailable. Do you search for the same type of contents?" as well as the attention message M3 and the selection button M2. The same type of contents signifies contents that deliver songs of the same artist or the same genre as the radio broadcast being audiovisually acquired.

If the selection button M2 for "End" is selected (NO at S112), the onboard unit 11 releases the connection to the Internet and then terminates the process. If the selection button M2 for "Re-search" is selected (YES at S112), the onboard unit 11 searches for the same type of contents (S113) and determines whether the same type of contents is available (S114). At S113 and S114, the onboard unit 11 may acquire the content information stored in the server 13 and perform the search. Alternatively, the server 13 may perform the search based on the audiovisual acquisition information transmitted at S103 and transmit a search result to the onboard unit 11.

The onboard unit 11 repeats the process at S105 and later if the search result indicates that the same type of contents is available (YES at S114). Specifically, the onboard unit 11 displays the precaution and then changes to reception (audiovisual acquisition) of the Internet radio according to the user's manipulation (S107). The onboard unit 11 then repeatedly determines whether the reception condition of the radio broadcast is improved (S108). If it is determined that the same type of contents is unavailable (NO at S114), the onboard unit 11 releases the connection to the Internet and then terminates the process.

Figure 11:
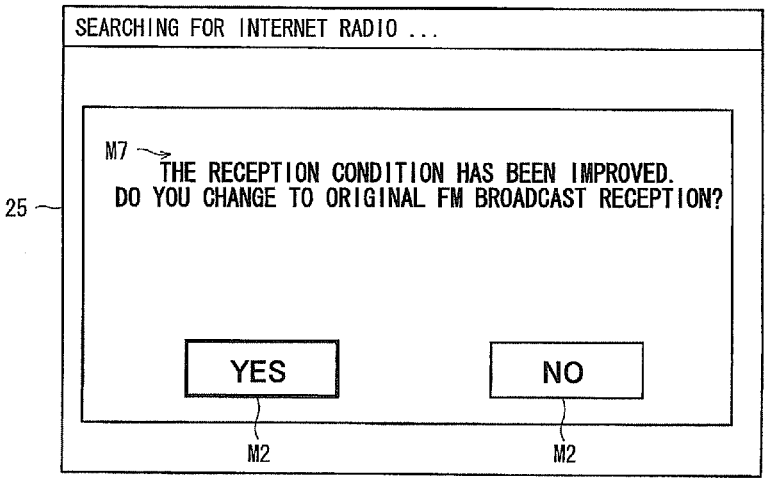
FIG. 11 illustrates a diagram of a third example of a screen display to change reception mode.

If the reception condition is improved (S108), the onboard unit 11 displays the guidance item ONS (S109). At S109, the onboard unit 11 accepts the manipulation to determine whether to change to reception of the radio broadcast as illustrated in FIG. 11. If the audiovisual acquisition is changed to the Internet radio after S114, the currently audiovisually acquired content belongs to the same type of contents as the previously audiovisually acquired radio broadcast but is not the same as the previous one. Even if the radio wave reception condition is improved, changing to reception of the radio broadcast acquires a content different from the currently audiovisually acquired content. If the process passes through S114, the onboard unit 11 displays a return confirmation message M7 such as "The reception condition has been improved. Do you return to FM broadcast?" as well as the selection button M2.

The onboard unit 11 changes the audiovisual acquisition to reception of the radio broadcast if "Yes" is selected, namely, if the user manipulation selects reception of the previous radio broadcast. On the other hand, the onboard unit 11 continues audiovisual acquisition of the Internet radio if "No" is selected, namely, if the user manipulation selects audiovisual acquisition of the Internet radio. This can satisfy the need for continued audiovisual acquisition of the Internet radio after the Internet radio is selected.

The above-mentioned embodiment provides the following effects. The onboard unit 11 changes a receiver of contents to the communicator 24, namely, to the Internet radio if an incorrect reception condition is detected during the radio broadcast or during reproduction of the content acquired by the tuner portion 23. Contents delivered via the Internet are available regardless of regions. The communicator 24 can enable audiovisual acquisition of the Internet radio even if the radio wave reception condition degrades to make difficult the audiovisual acquisition of the radio broadcast. This enables continued audiovisual acquisition of contents acquired by the tuner portion 23 such as the radio broadcast even if the vehicle moves outside the broadcast region to degrade the radio wave reception condition.

Suppose a case where the radio wave reception condition degrades to necessitate audiovisual acquisition of the Internet radio and the radio wave reception condition is improved later on. In such a case, the onboard unit 11 changes the audiovisual acquisition from the Internet radio to the radio broadcast. If the radio wave reception condition is improved, the onboard unit 11 receives the radio broadcast free from the communication charge or the usage charge. This can prevent the pay-as-you-go service from too much charging audiovisual acquisition of the Internet radio.

After S114 in FIG. 5, the Internet radio may provide a content different from the radio broadcast that was audiovisually acquired. When changing the Internet radio to the radio broadcast, the onboard unit 11 accepts the manipulation to determine whether to change the audiovisual acquisition to reception of the radio broadcast as illustrated in FIG. 11. The user can thereby choose to continue the audiovisual acquisition from the Internet radio or to change the audiovisual acquisition to the previous radio broadcast. This can satisfy the need for continued audiovisual acquisition of the Internet radio.

The onboard unit 11 specifies information about the content being audiovisually acquired such as the broadcast station name and the frequency. The onboard unit 11 acquires the same content as the specified one via the Internet. This enables continued audiovisual acquisition of the same content. Some broadcast stations may not deliver broadcast contents as the Internet radio. In such a case, the onboard unit 11 can search for and acquire the same type of contents by specifying the type of contents such as an artist name or a genre of songs. The user can acquire contents suitable for his or her preferences and the convenience can be improved even if the Internet radio does not deliver the same content.

If the Internet radio is audiovisually acquired, the onboard unit 11 provides the charging information about charging. The onboard unit 11 starts audiovisual acquisition of the Internet radio in response to the user's manipulation that allows the charging. This can prevent the user from being disadvantaged due to unexpected charging if the user subscribes to the pay-as-you-go service, for example.

The onboard unit 11 connects with the mobile communication terminal 12 using Bluetooth. The mobile communication terminal 12 can be prevented from decreasing the battery life while the power is always supplied during audiovisual acquisition of the Internet radio.

The vehicular communication system 10 including the onboard unit 11 can provide the above-mentioned effects.

In the vehicular communication system 10, the server 13 searches for the same content or the same type of content as the currently audiovisually acquired one based on the audiovisual acquisition information transmitted from the onboard unit 11. The server 13 stores the information about contents delivered by way of the communication line network 15. Accordingly, the onboard unit 11 need not perform the search process. This can decrease processes on the onboard unit 11 and shorten the time to connect to the communication line network 15. The mobile communication terminal 12 can be protected against battery drain. The charging for the data communication can be saved.

Second Embodiment

The following describes the vehicular communication apparatus and the vehicular communication system according to the second embodiment of the disclosure with reference to FIGS. 12 through 15. The vehicular communication apparatus and the vehicular communication system according to the second embodiment differ from the first embodiment in that a content acquisition destination is changed manually. Configurations of the vehicular communication apparatus and the vehicular communication system are equivalent to the first embodiment. The following description also refers to FIG. 1 and a detailed description is omitted for simplicity.

Suppose a case where "No" is selected in FIG. 4 to disable the automatic changeover process in the above-mentioned radio reception setup. In such a case, the onboard unit 11 according to the second embodiment performs a manual changeover process illustrated in FIG. 12. The manual changeover process in FIG. 12 has many steps in common with the automatic changeover process in FIG. 5 and a description about the common steps is omitted for simplicity.

Figure 12:
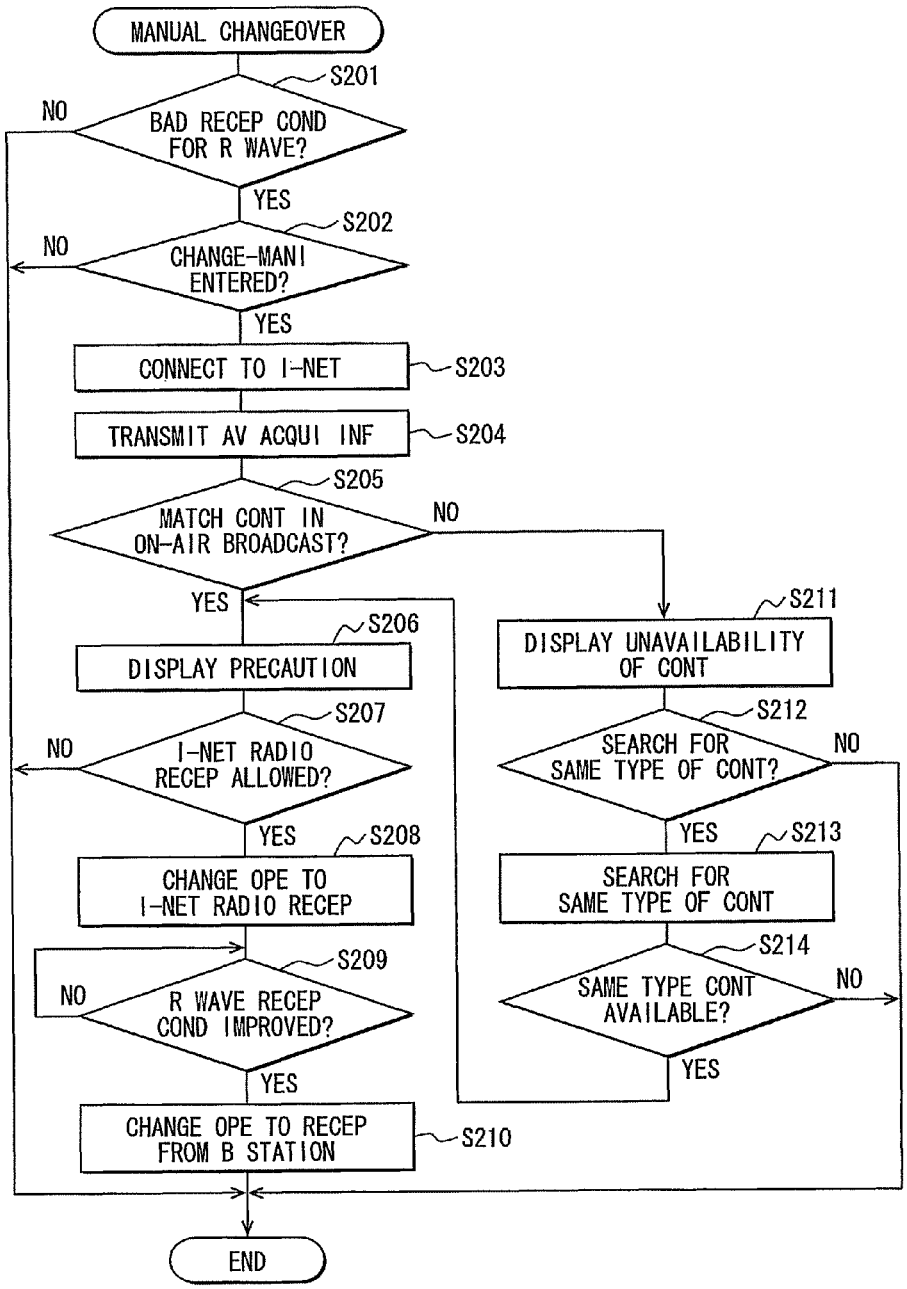
FIG. 12 illustrates a flowchart of a manual changeover process according to a second embodiment.
Figure 13:
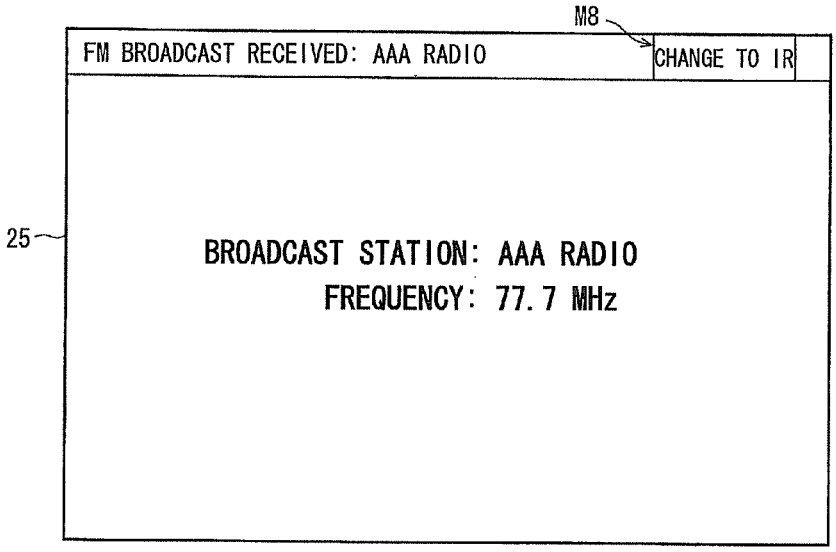
FIG. 13 illustrates a diagram of a screen display for radio-broadcast reception.

The manual changeover process in FIG. 12 may indicate that the radio wave reception condition degrades (YES at S201). The onboard unit 11 displays a change button M8 as illustrated in FIG. 13 and then determines whether the user manipulates the change button M8 as change manipulation (S202). FIG. 13 illustrates an example of the screen display during radiobroadcast reception and displays the broadcast station name and the frequency corresponding to the reception. If the change manipulation is performed (YES at S202), the onboard unit 11 connects to the Internet similarly to the first embodiment (S203) and transmits the audiovisual acquisition information (S204). If a matching content is delivered (YES at S205), the onboard unit 11 displays the precaution ONS (S206). If the Internet radio reception is allowed (YES at S207), the onboard unit 11 changes the operation to reception (audiovisual acquisition) of the Internet radio (S208).

The onboard unit 11 determines whether the radio wave reception condition is improved (S209). If the radio wave reception condition is improved (YES at S209), the onboard unit 11 changes the operation to reception from the broadcast station (S210). The second embodiment does not enable the automatic changeover process. The user is assumed to basically avoid charging. Therefore, if the radio wave reception condition is improved, the onboard unit 11 changes the operation to the radio broadcast without displaying the guidance item as described in the first embodiment (see S109). This can early disable the connection to the Internet and prevent the charging from increasing.

Figure 14:
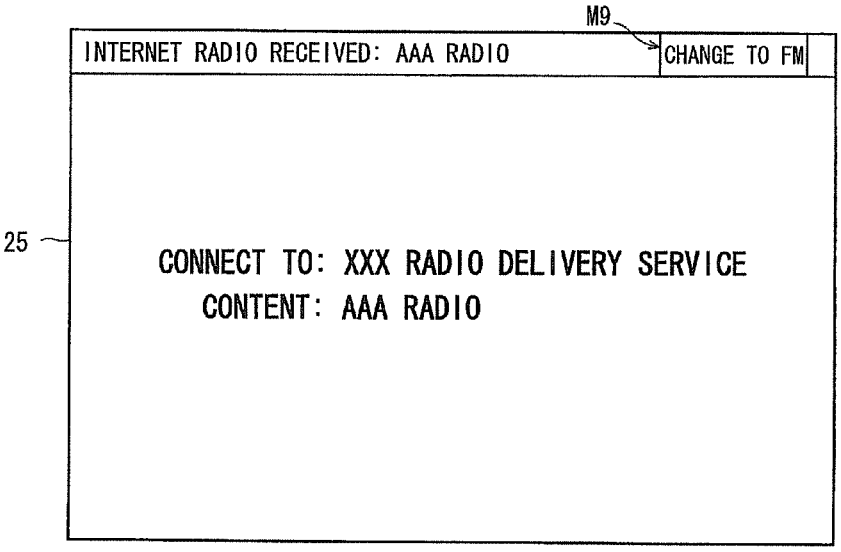
FIG. 14 illustrates a diagram of a screen display for Internet radio reception.

During audiovisual acquisition of the Internet radio, the onboard unit 11 displays the connection destination and the type of the delivered content as illustrated in FIG. 14. The example in FIG. 14 displays XXX Radio Delivery Service, i.e., the service name of the service provider as the connection destination and AAA Radio, i.e., the broadcast station name as the content. The onboard unit 11 also displays a change button M9 that accepts input manipulation to enable reception of the radio broadcast. Using the change button M9, the user can change the operation to reception of the radio broadcast at any time.

Figure 15:
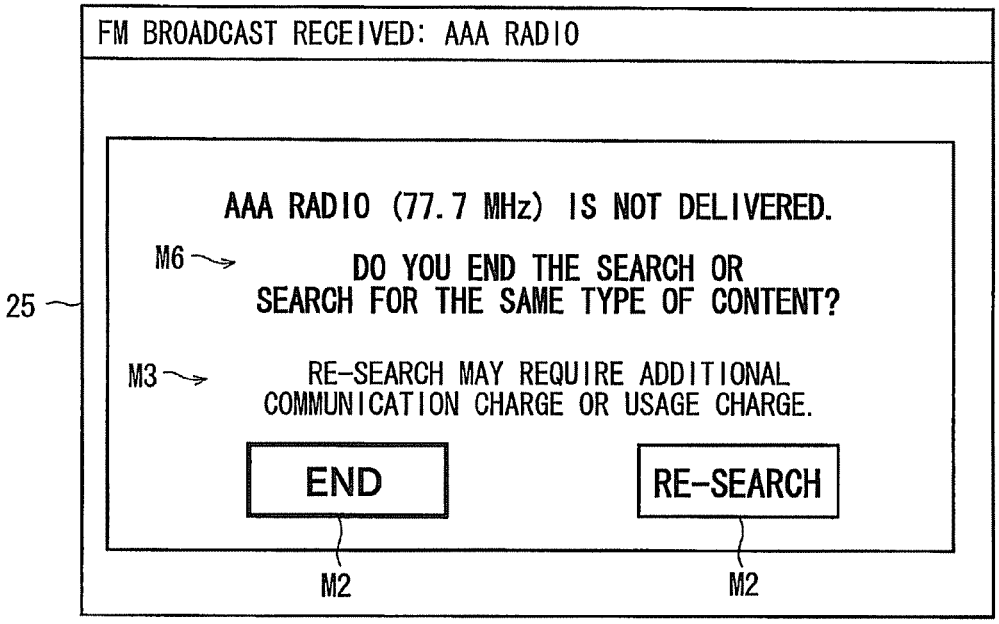
FIG. 15 illustrates a diagram of a screen display for content re-search.

The manual changeover process in FIG. 12 may determine that there is no matching content to be delivered (YES at S206). As illustrated in FIG. 15, the onboard unit 11 displays the search message M6, the attention message M3, and the selection button M2 to prompt the user's manipulation. If the selection button M2 for "End" is selected (NO at S212), the onboard unit 11 disables the connection to the Internet and terminates the process. If the selection button M2 for "Research" is selected (YES at S212), the onboard unit 11 searches for the same type of contents (S213). If the same type of contents is available (YES at S214), the onboard unit 11 performs the process at S206 and later.

The function is provided to manually change the content acquisition destination if the radio broadcast reception condition degrades. The on-air content can be uninterruptedly acquired via the Internet. The convenience can be improved.

In addition, the second embodiment can also notify possible charging and accept user's manipulation. The second embodiment provides the same effects as the first embodiment such as the prevention against unexpected charging.

Other Embodiments

The disclosure is not limited to the embodiments. Various changes and modifications may be made in the disclosure without departing from the spirit and scope thereof.

According to the embodiments, the tuner portion 23 receives the radio broadcast. The tuner portion 23 may receive television broadcast. A "content delivered by way of a communication line network" includes radio broadcast and television broadcast. If the content signifies television broadcast, the display portion 25 and the speaker 27 are equivalent to a reproduction portion.

The first embodiment displays the precaution screen as illustrated in FIG. 7. The precaution screen may not be displayed if the automatic changeover process is enabled. For example, the flat-rate service does not increase the communication charge if the Internet radio is audiovisually acquired. Suppose a case where selection is made not to display the precaution screen from a setup menu that determines whether to display the precaution screen. In such a case, audiovisual acquisition of the Internet radio may start without displaying the precaution screen.

According to the embodiments, the onboard unit 11 transmits the audiovisual acquisition information such as the radio broadcast frequency or the broadcast station name to the server 13. For example, suppose a case where the radio wave for radio broadcast also transmits data concerning the content. Namely, the radio wave delivers information (equivalent to first attribute information) that is delivered along with the content and contains at least the content type such as a song name or an artist name. In such a case, the onboard unit 11 may specify the content type. The onboard unit 11 transmits the specified content type as the audiovisual acquisition information to the server 13. The server 13 searches for a URL of the connection destination that delivers the same content or the same type of content.

Suppose a case where the server 13 uses the communication line network 15 to deliver the content information (equivalent to second attribute information) that includes at least the type of contents such as program names or song names currently delivered from the radiobroadcast station 14. In such a case, the tuner portion 23 (first acquisition portion) may specify the type of content being acquired based on the content information. The onboard unit 11 may specify the same content or the same type of content based on the content information.

The universal serial bus (USB) may be used to make connection between the onboard unit 11 and the mobile communication terminal 12. The USB connection enables power supply from the onboard unit 11 and protects the mobile communication terminal 12 against battery drain during audiovisual acquisition of the Internet radio.

The embodiments have provided only examples of displaying the messages and the manipulation screens and the disclosure is not limited thereto.

The embodiments have provided examples of acquiring the same content or the same type of content currently delivered by way of the communication line network 15. The same type of content may be acquired from archives or records of contents delivered in the past.

The above disclosure has the following aspects.

According to a first aspect of the present disclosure, a vehicular communication apparatus includes: a first acquisition portion that receives a radio wave transmitted from an external broadcast station and acquires a first content delivered by way of the radio wave; a second acquisition portion that performs data communication with an external communication line network and acquires a second content delivered by the external communication line network; a reproduction portion that reproduces the first content acquired by the first acquisition portion and the second content acquired by the second acquisition portion; a determination portion that determines whether a radio wave reception condition is poor so that a poor radio wave reception condition affects content acquisition in the first acquisition portion; and a controller that changes a content to be reproduced by the reproduction portion from the first content to the second content when the determination portion detects the poor radio wave reception condition under a condition that the reproduction portion reproduces the first content, the second content being a same or a similar type of the first content.

The vehicular communication apparatus changes content acquisition destinations according to the radio wave reception condition. Accordingly, a user can continuously audiovisually acquire the content acquired by the first acquisition portion even if a vehicle moves out of a broadcast region and the radio wave reception condition degrades. Some broadcast stations may not deliver on-air contents via the communication line network. Even in this case, the user can acquire the same type of contents that meet his or her preferences.

Alternatively, the controller may change a content to be reproduced by the reproduction portion from the second content to the first content when the determination portion determines that the radio wave reception condition is not poor under a condition that the reproduction portion reproduces the second content. Acquiring contents from second acquisition portion may require charging such as a communication charge or a usage charge for data communication, for example. On the other hand, no charging occurs during reception of radio broadcast in which the first acquisition portion acquires contents. If the radio wave reception condition improves, acquiring contents using the first acquisition portion can prevent the charging from increasing.

Alternatively, the first acquisition portion may further acquire first attribute information together with the first content delivered by way of the radio wave. The first attribute information includes information indicative of a type of the first content. The second acquisition portion further acquires second attribute information together with the second content delivered by way of the external communication line network. The second attribute information includes information indicative of a type of the second content. The controller specifies the type of the first content according to one of the first attribute information and the second attribute information. Thus, the vehicular communication apparatus can acquire the same content as or the same type of content as the content acquired by the first acquisition portion.

Alternatively, the vehicular communication apparatus may further include: a notification portion that notifies charging information about a fee charge when the second acquisition portion acquires the second content; and a manipulation input portion that inputs manipulation with respect to the charging information notified by the notification portion. When the notification portion notifies the charging information, and the manipulation input portion inputs the manipulation to allow the fee charge, the controller starts to acquire the second content. Acquiring contents using the second acquisition portion increases the charging if the user subscribes to a pay-as-you-go service that increases the charging according to the amount of data. The user may unintentionally increase the charging if he or she chooses the second acquisition portion as a content acquisition destination because the radio wave reception condition degrades. To solve this problem, the second acquisition portion starts acquiring contents if the user inputs the manipulation that allows the charging. This can prevent the user from being disadvantaged due to an unexpected increase in the charging.

According to a second aspect of the present disclosure, a vehicular communication system includes: the vehicular communication apparatus according to the first aspect; a mobile communication terminal that is connected to the vehicular communication apparatus so that the mobile communication terminal mediates the data communication between the vehicular communication apparatus and the external communication line network; and a server that is connected to the external communication line network, and stores content information about the first content delivered by way of the radio wave and the second content delivered by way of the communication line network. The vehicular communication apparatus transmits audiovisual acquisition information to the server. The audiovisual acquisition information indicates the first content that is acquired by the first acquisition portion and is being reproduced by the reproduction portion. The server searches for the same or the similar type of the first content based on the audiovisual acquisition information transmitted from the vehicular communication apparatus. The vehicular communication system can provide the effects in the first aspect described above. The server stores information about contents delivered by way of the communication line network. The vehicular apparatus need not perform the search process. This can decrease processes on the vehicular apparatus and shorten the time to connect to the communication line network. The mobile communication terminal can be protected against battery drain. Possible charging in the data communication can be controlled.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A vehicular communication apparatus comprising:

a first acquisition portion that receives a radio wave transmitted from an external broadcast station and acquires a first content delivered by way of the radio wave;

a second acquisition portion that performs data communication with a fee based external communication line network and acquires a second content delivered by the external communication line network;

a reproduction portion that reproduces the first content acquired by the first acquisition portion and the second content acquired by the second acquisition portion;

a determination portion that determines whether a radio wave reception condition is poor so that a poor radio wave reception condition affects content acquisition in the first acquisition portion;

a controller that changes a content to be reproduced by the reproduction portion from the first content to the second content when the determination portion detects the poor radio wave reception condition under a condition that the reproduction portion reproduces the first content, the second content being a same or a similar type of the first content;

a notification portion that notifies charging information about a fee charge when the second acquisition portion acquires the second content; and a manipulation input portion that inputs manipulation with respect to the charging information notified by the notification portion, wherein, when the notification portion notifies the charging information, and the manipulation input portion inputs the manipulation to allow the fee charge, the controller starts to acquire the second content.

2. The vehicular communication apparatus according to claim 1, wherein the controller changes a content to be reproduced by the reproduction portion from the second content to the first content when the determination portion determines that the radio wave reception condition is not poor under a condition that the reproduction portion reproduces the second content.

3. The vehicular communication apparatus according to claim 1, wherein the first acquisition portion further acquires first attribute information together with the first content delivered by way of the radio wave, wherein the first attribute information includes information indicative of a type of the first content, wherein the second acquisition portion further acquires second attribute information together with the second content delivered by way of the external communication line network, wherein the second attribute information includes information indicative of a type of the second content, wherein the controller specifies the type of the first content according to one of the first attribute information and the second attribute information.

4. A vehicular communication system comprising:

the vehicular communication apparatus according to claim 1;

a mobile communication terminal that is connected to the vehicular communication apparatus so that the mobile communication terminal mediates the data communication between the vehicular communication apparatus and the external communication line network; and a server that is connected to the external communication line network, and stores content information about the first content delivered by way of the radio wave and the second content delivered by way of the communication line network, wherein the vehicular communication apparatus transmits audiovisual acquisition information to the server, wherein the audiovisual acquisition information indicates the first content that is acquired by the first acquisition portion and is being reproduced by the reproduction portion, and wherein the server searches for the same or the similar type of the first content based on the audiovisual acquisition information transmitted from the vehicular communication apparatus.

* * * * *